US005634308A

United States Patent [19]

Doolan

[11] Patent Number: 5,634,308

[45] Date of Patent: Jun. 3, 1997

[54] MODULE COMBINED GIRDER AND DECK CONSTRUCTION

[76] Inventor: Terence F. Doolan, River Street, Brushgrove, Australia, NSW 2460

[21] Appl. No.: 433,447

[22] PCT Filed: May 11, 1993

[86] PCT No.: PCT/AU93/00575

§ 371 Date: May 5, 1995

§ 102(e) Date: May 5, 1995

[87] PCT Pub. No.: WO94/10389

PCT Pub. Date: May 11, 1994

[30] Foreign Application Priority Data

Nov. 5, 1992 [AU] Australia ..... PL5695
May 5, 1993 [AU] Australia ..... PL8625

[51] Int. Cl.[6] ..... E01D 19/00

[52] U.S. Cl. ..... 52/334; 52/327; 52/602; 52/730.7; 52/250; 52/223.8; 52/745.19; 14/73

[58] Field of Search ..... 52/334, 327, 328, 52/329, 330, 600, 601, 602, 250, 223.8, 730.7, 745.19; 14/73, 75, 6

[56] References Cited

U.S. PATENT DOCUMENTS

| | | | |
|---|---|---|---|
| 890,769 | 6/1908 | Hewett | 14/73 X |
| 1,385,421 | 7/1921 | Beach . | |
| 1,526,359 | 2/1925 | Michie | 14/73 X |
| 1,597,278 | 8/1926 | Kahn | 52/334 |
| 2,047,109 | 7/1936 | Nagel | 52/327 X |
| 2,184,137 | 12/1939 | Brewer | 14/73 X |
| 3,605,353 | 9/1971 | Marcott | 52/600 X |
| 3,624,980 | 12/1971 | McManus | 52/334 X |
| 3,728,835 | 4/1973 | McManus | 52/334 |
| 4,555,888 | 12/1985 | Goldenberg et al. | 52/602 X |
| 4,604,841 | 8/1986 | Barnoff et al. | 14/73 X |
| 4,700,516 | 10/1987 | Grossman | 52/334 X |
| 4,972,537 | 11/1990 | Slaw, Sr. | 14/73 X |
| 5,125,200 | 6/1992 | Natterer | 52/327 X |
| 5,305,563 | 4/1994 | Erel | 52/79.13 X |
| 5,339,475 | 8/1994 | Jaeger et al. | 14/73 |
| 5,433,049 | 7/1995 | Karlsson et al. | 52/602 X |

FOREIGN PATENT DOCUMENTS

| | | | |
|---|---|---|---|
| 100407 | 3/1937 | Australia | 14/73 |
| 80682 | 1/1951 | Czechoslovakia | 52/334 |
| 403421 | 9/1909 | France | 52/602 |
| 449485 | 2/1913 | France | 52/334 |
| 667419 | 10/1929 | France | 52/334 |
| 2590631 | 5/1987 | France . | |
| 2627526 | 8/1989 | France . | |
| 1808971 | 8/1969 | Germany . | |
| 250559 | 10/1987 | Germany . | |
| 4-166539 | 6/1992 | Japan | 52/600 |
| 147365 | 8/1931 | Switzerland | 52/334 |
| 1272997 | 11/1986 | U.S.S.R. | 52/600 |
| 545526 | 6/1942 | United Kingdom | 52/602 |
| 743391 | 1/1956 | United Kingdom | 52/334 |
| WO94/11589 | 5/1994 | WIPO | 52/600 |

*Primary Examiner*—Carl D. Friedman
*Assistant Examiner*—Laura A. Saladino
*Attorney, Agent, or Firm*—Stetina Brunda & Buyan

[57] ABSTRACT

A structural module has a cast concrete portion and a girder. The concrete portion has a reinforced deck with a reinforced load bearing a diaphragm at opposite ends. The girder extends between the diaphragms and protrudes into each diaphragm without structural connection thereto while being shear and tension coupled to the deck such that forces induced in the girder are transferred to the diaphragms via the coupling between the girder and the deck.

16 Claims, 18 Drawing Sheets

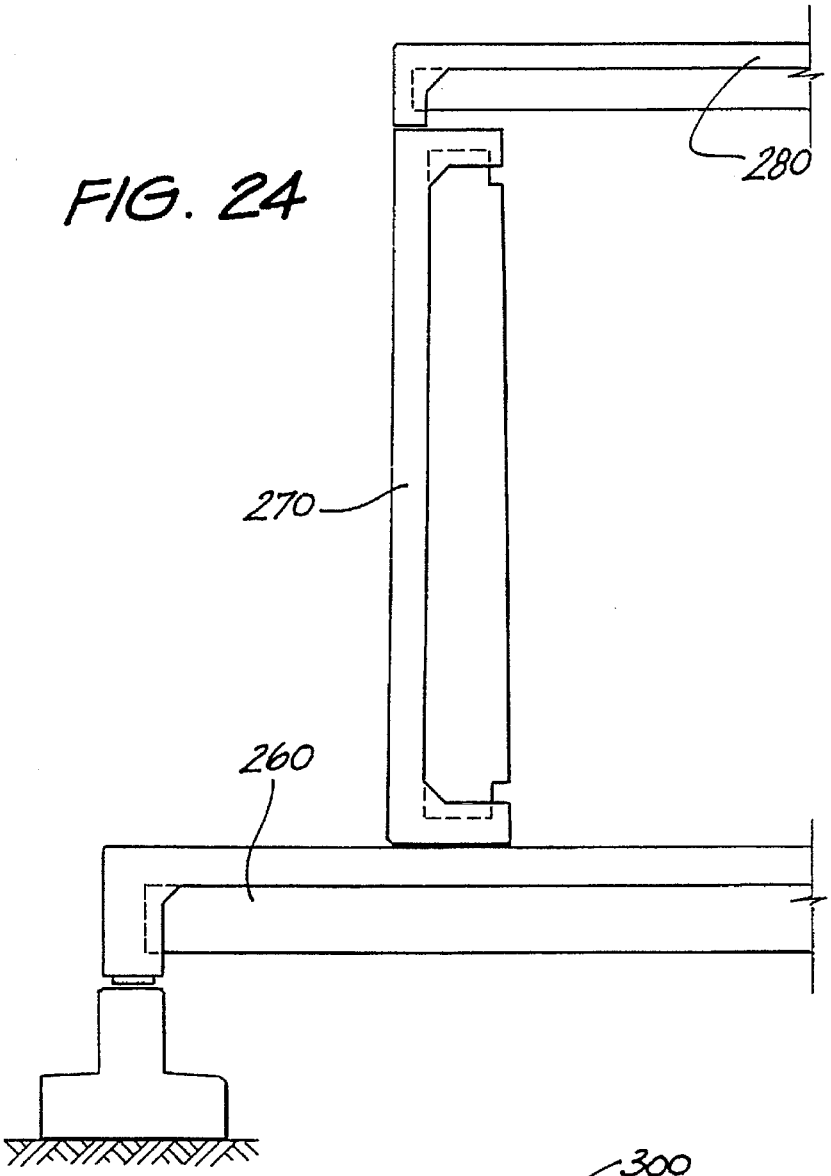
FIG. 24
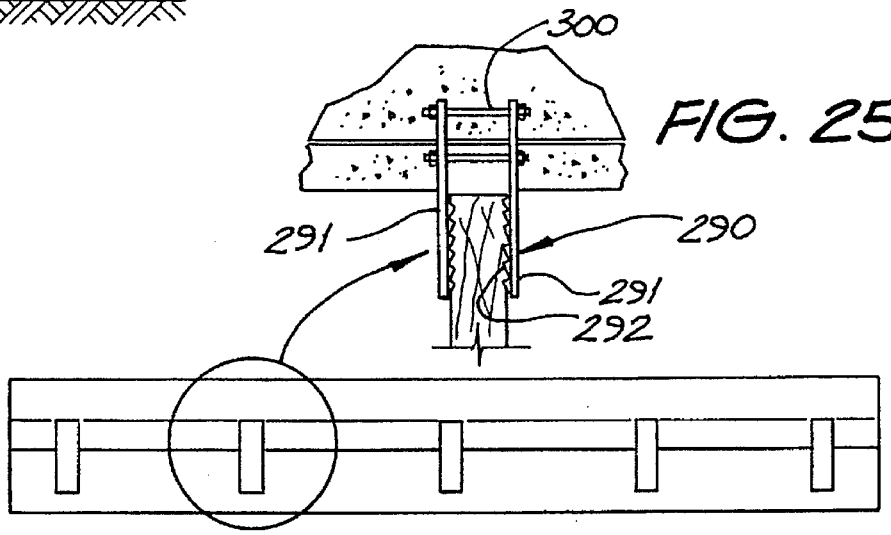
FIG. 25A
FIG. 25

MODULE COMBINED GIRDER AND DECK CONSTRUCTION

FIELD OF THE INVENTION

The invention pertains to a building or construction element which in a preferred form is a combined girder and deck which can be used in the repair, rehabilitation or construction of roads and bridges and as building element in other, structural applications. More particularly, the combined girder and deck comprise a module which is fabricated, in part, from cast concrete.

BACKGROUND OF THE INVENTION

It is well appreciated that one of the major problems facing road authorities and local councils is the maintenance and replacement of a large population of aging timber bridges. One of the reasons for such a large number of timber structures lies in the fact that Australia, for example, was blessed with vast supplies of durable and strong hardwood timber. However, a point has been reached in Australia and elsewhere, where large sawn timber is not available in sufficient quanties to continue to economically maintain these structures in the traditional manner. It is well known that the supply of large diameter logs is quickly diminishing as old growth forests disappear. Consequently the cost of timber has risen sharply. Over the past ten years, the cost of good quality large sawn hardwood timber has risen by about a factor of four.

From an environmental point of view, alternative methods and materials are needed to replace aging timbers or reduce the need for such timbers.

Because timber is dimensionally unstable (that is as the moisture content varies it swells or shrinks by as much as ten percent perpendicular to the grain) and is also biologically unstable if exposed to the elements, it has to date been considered as a temporary material in outdoor construction. Thus timber structures have been repaired in the traditional manner which involves replacing members as they degrade.

Also, because natural round timber is irregular in its natural form, it is sawn to produce a more uniform product. Up to sixty percent of the timber is lost at the mill and a material of inferior strength is produced because some load carrying fibres are severed and knots are exposed.

The invention, in one application, replaces large sawn timber with reinforced concrete and combines this in the preferred embodiment with natural round timber which is in reasonable supply and can be obtained from plantations and regrowth forests.

OBJECT AND SUMMARY OF THE INVENTION

It is an object of the invention to provide a modular load carrying member which combines a girder and a deck into a single structure.

The invention aims to produce a substantially dimensionally stable and accurate load carrying member or building element which is capable of accommodating a dimensionally unstable girder as the main load carrying member, but is equally suited to accommodating a dimensionally stable girder.

The present invention consists in a structural module comprising:

a cast concrete portion; and a girder;

the cast concrete portion comprising a reinforced deck having a reinforced load bearing diaphragm at opposite ends;

the girder extending between the diaphragms and being shear coupled to the deck whereby forces induced in the girder are transferred to the diaphragms via shear transfer between the girder and the deck.

In a preferred embodiment, the module combines a cast concrete deck and end diaphragms with a round timber.

Preferably the module, when in use, is adapted to protect the girder from the elements, in particular water, which could degrade the girder where it is of timber.

In a preferred embodiment the module is formed by a cast reinforced concrete deck and end diaphragms with a round timber cast in an inverted position on a flat bed.

This upside down method of casting provides for denser and consequently more durable concrete at the wearing surface and allows a tread or non skid pattern to be cast into the surface.

The module in its simplest form can provide a complete bridge or building element.

The modules may be coupled together to form large elements while being fully demountable if required (e.g. if bolted or stressed together) and may be reused.

The modules may be made contiguous by gluing or casting insitu with concrete between modules or by some other means.

BRIEF DESCRIPTION OF THE DRAWING FIGURES

FIG. 24 illustrates modules according to the teachings of the present invention utilising constructing a floor, wall and ceiling of a building structure.

FIG. 25 is a side elevation of a module.

FIG. 25*a* is an enlarged view of a portion of the module of FIG. 25 showing how small timbers can be gripped by a jaws-like apparatus which is embedded in the deck.

Figure 26:
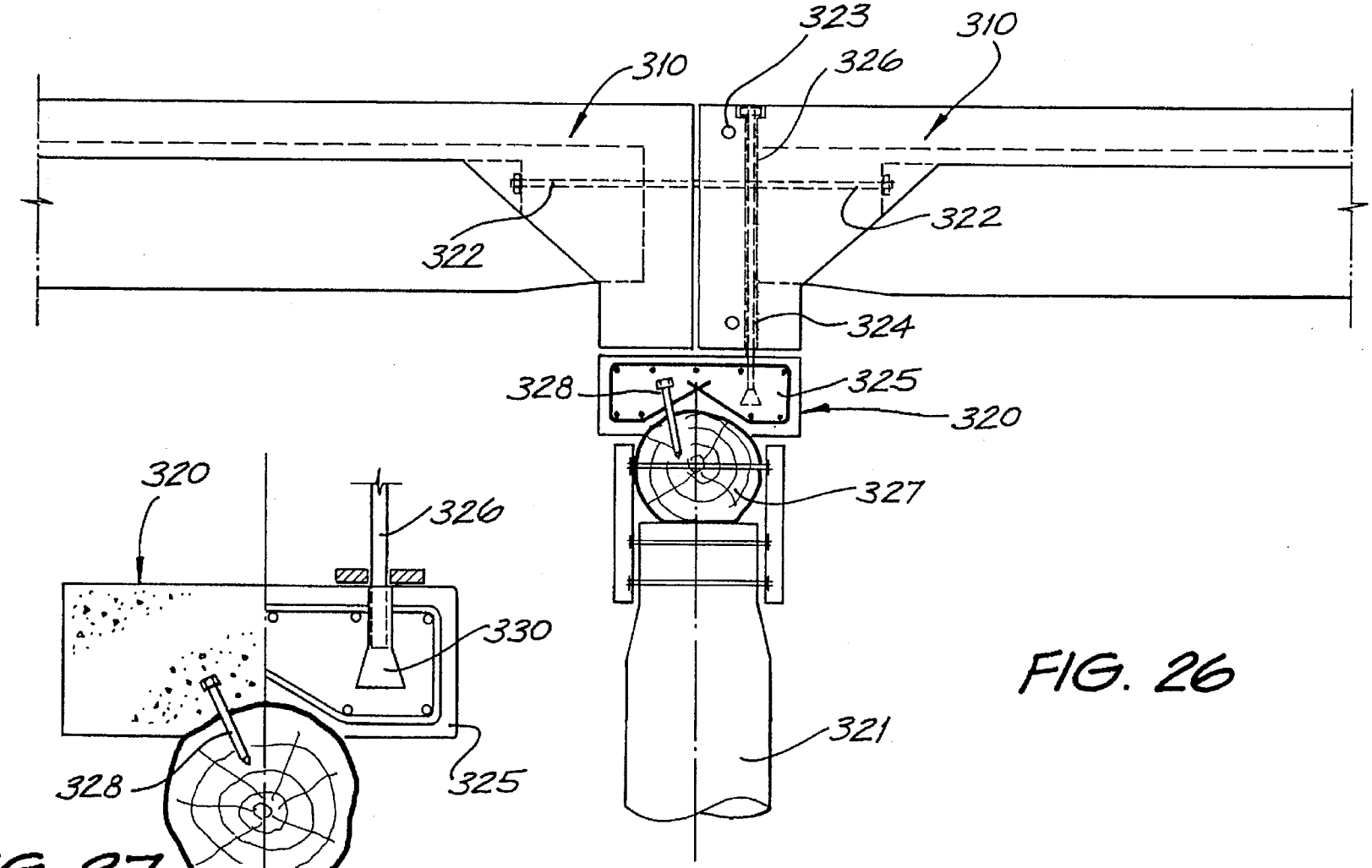

FIG. 26 is a cross-section of, for example, a repaired bridge pier. Adjacent modules are joined to one another by a horizontal fastener. The modules rest on a support which is itself fabricated from reinforced cast concrete into which is embedded a round timber. The modules are affixed to this support by a vertical rod which is embedded in the support.

Figure 27:
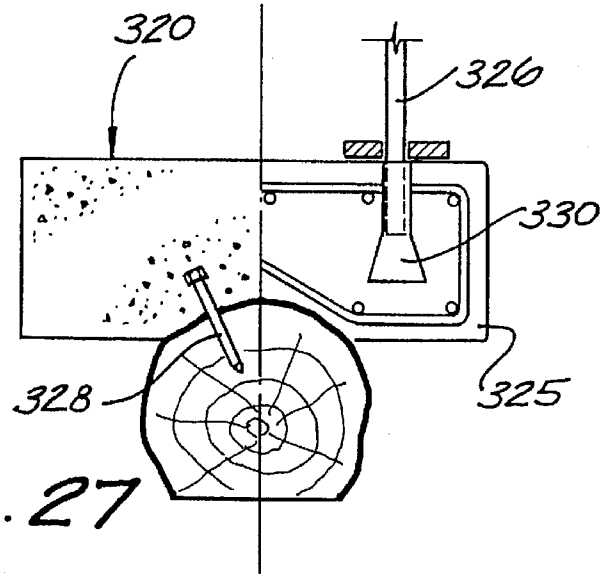

FIG. 27 is a cross-sectional detail of the support depicted in FIG. 26.

DESCRIPTION OF A PREFERRED EMBODIMENT AND OTHER EMBODIMENTS OF THE INVENTION

As will be apparent from the following description, a preferred embodiment of the invention uses the outstanding strength and durability qualitites of hardwood and some treated softwood timbers and Australian hardwood timbers in combination with reinforced concrete to produce a composite, high strength, structural member which has applications in bridges, wharves, roof structures and has tilt up walls or tilt up structural columns. The product is necessarily modular. In the preferred embodiment, the combination of materials allows the concrete to protect the timber from moisture and resulting degradation. While the use of round timbers is shown in some of the examples, it would be understood that square or rectangular timbers, kiln dried timber or laminated timber, may be used as well.

In some embodiments, the modules are cast in an upside down position. This allows for irregularities of round timbers to be easily accommodated. Utilising this method, the timber, steel or concrete girder is lowered into or suspended into the slab portion of the module with suitable shear connections into the inverted stab which later becomes the running surface. The nature of the casting must be capable of easily accommodating the irregular dimensions of natural round timber girder so that the full strength of the round timber is realised. The module should at the same time be capable of protecting the girder from moisture which could degrade the girder in the case of timber. Typically, the slab is only about 150 mm thick and is easy to cast in an upside-down manner on the ground. Any pattern for skid resistance may be incorporated into the top surface. It will be observed that the high shrinkage characteristics of timber and Australian hardwoods are accommodated in the method of shear and load transfer.

A typical length of a module for bridge applications may be about 10 meters long. This will suit the vast majority of timber bridges. The module has a large reserve strength and would be suitable for even longer lengths.

Modules may be bolted, dowelled, glued or stressed together in the transverse direction. They may be then bolted together, as will be described, through the diaphragms of each to keep joints tight in the direction of traffic. Provision for holding down bolts is also made. It will be appreciated that various combinations of module cross-section, width and length will allow for the full range of bridge widths and spans to be accommodated.

Where round timbers are specified in the specification, timbers of about 500 mm in diameter are envisaged. Smaller or larger timbers may also be used. 500 mm diameter timber is in plentiful supply and involves little waste at the mill. This also allows for the reuse of sound timber girders in the production of modules. The method also allows for the use of hitherto unacceptable species of hardwood such as spotted gum and blackbutt which are in plentiful supply. These timbers are suitable for preservation treatment.

Given the fact that timber prices are on the increase, it is believed that modules can be manufactured and installed at the same cost as repairing a timber bridge structure in the traditional manner. Given the premise that decking needs to be replaced about every 15 years, employment of the invention will allow many timber bridges to be recycled at the end of their 15-year life cycle.

Figure 2:
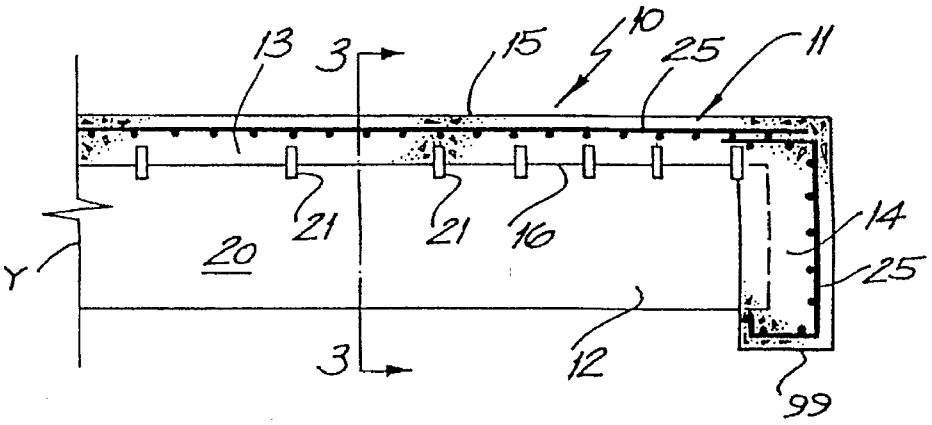
FIG. 2 is a partial side elevation of a module utilising a round timber beam and shear connectors between the beam and the concrete deck. A right half is shown.
Figure 1:
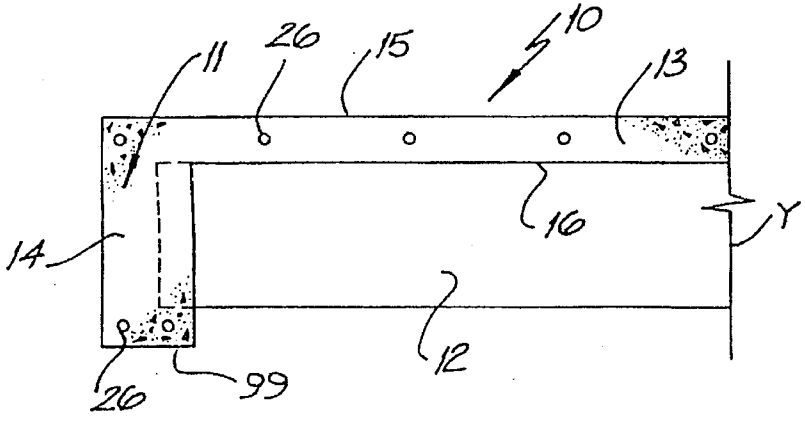
FIG. 1 is a partial side elevation of a module according to the teachings of the present invention. This view shows only a left half of a module.

As shown in FIGS. 1 and 2 a module 10 according to the present invention comprises a reinforced concrete portion 11 and a girder 12. The girder 12 may be steel, timber or concrete or combinations of these. The cast reinforced concrete portion 11 further comprises a deck surface 13 and a diaphragm 14 at each end. It will be appreciated that FIGS. 1 and 2 are abbreviated representations, each being generally symmetrical about the vertical axis "Y". The deck 13 has a top surface or road surface 15 and an underside 16.

As shown more particularly in FIG. 2 (and FIG. 6) a round timber 20 may be cast into the underside 16 of the deck 13. Preferably, the ends of the round timber 20 are at least partially embedded into the diaphragm 14. In order to provide a shear connection between the round timber 20 and the deck 13, shear connectors 21 are embedded in the timber 20 and also cast into the deck 13. The shear connectors shear couple the girder to the deck. The shear connectors 21 may be in the form of plates, bolts, bars or studs and are preferably steel. In corrosive environments, it may be advantageous to use stainless steel or plastic shear connectors. As shown in FIG. 2 steel reinforcement 25 is advantageously located both within the deck 13 and within the diaphragm 14. FIG. 1 further illustrates how transverse through ducts 26 provide openings through which dowells or reinforcement may be located for transversely stressing laterally adjacent modules.

Figure 3:
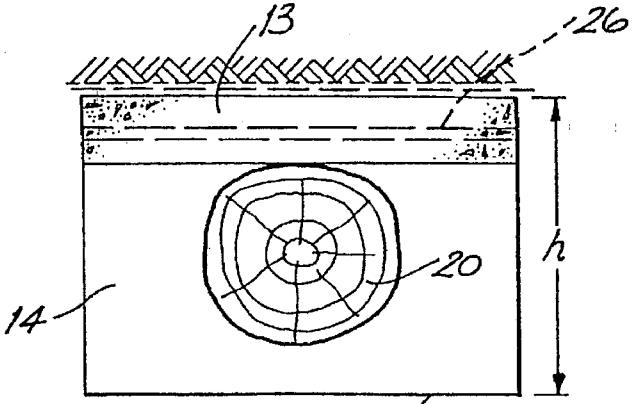
FIG. 3 is a cross-section through lines 3–3 of FIG. 2, but where the module is inverted showing its orientation with respect to a casting bed.

FIG. 3 illustrates (upside down) a module located in a casting bed. Modules are preferably cast upside down. In this example, the height of the module "h" is about 800 mm and the width of the module "w" is about 1200 mm. The bottom faces 99 of each diaphragm are preferably flat. The thickness of the deck is about 150 mm. A 500 mm diameter hardwood girder 20 is used.

Figure 4:
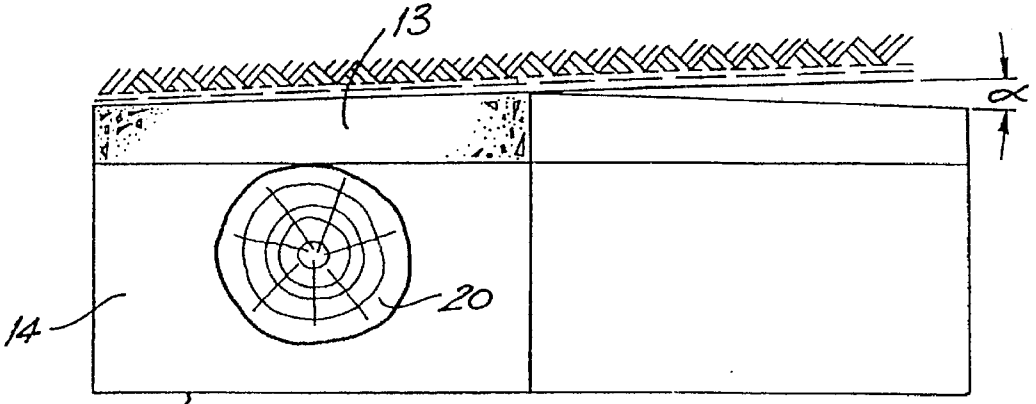
FIG. 4 is a cross-section through a module resting in a casting bed.

FIG. 4 shows match casting. In this method, the module is cast, then moved sideways, then rotated through angle "α".

Figure 5:
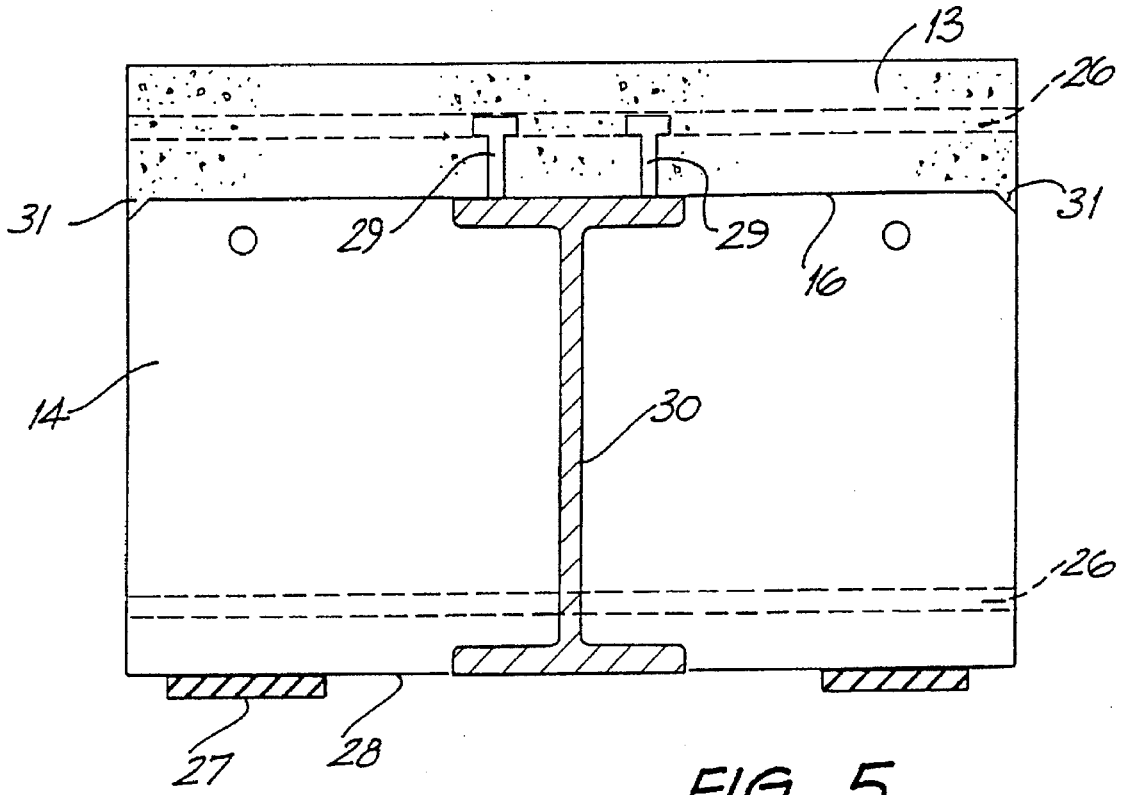
FIG. 5 is a cross-section through a module in which a steel I-beam is used.

FIG. 5 illustrates an alternate embodiment in which a steel I-beam 30 is used as a girder. As illustrated, the I-beam or girder extends from the underside 16 of the deck 13 to the bottom 28 of the diaphragms 14. A number of shear connectors 29, such as bolts or integral studs extend into and are cast into the deck slab 13. In a typical application, each of the diaphragms 14 will rest on elastomeric pads 27.

Figure 6:
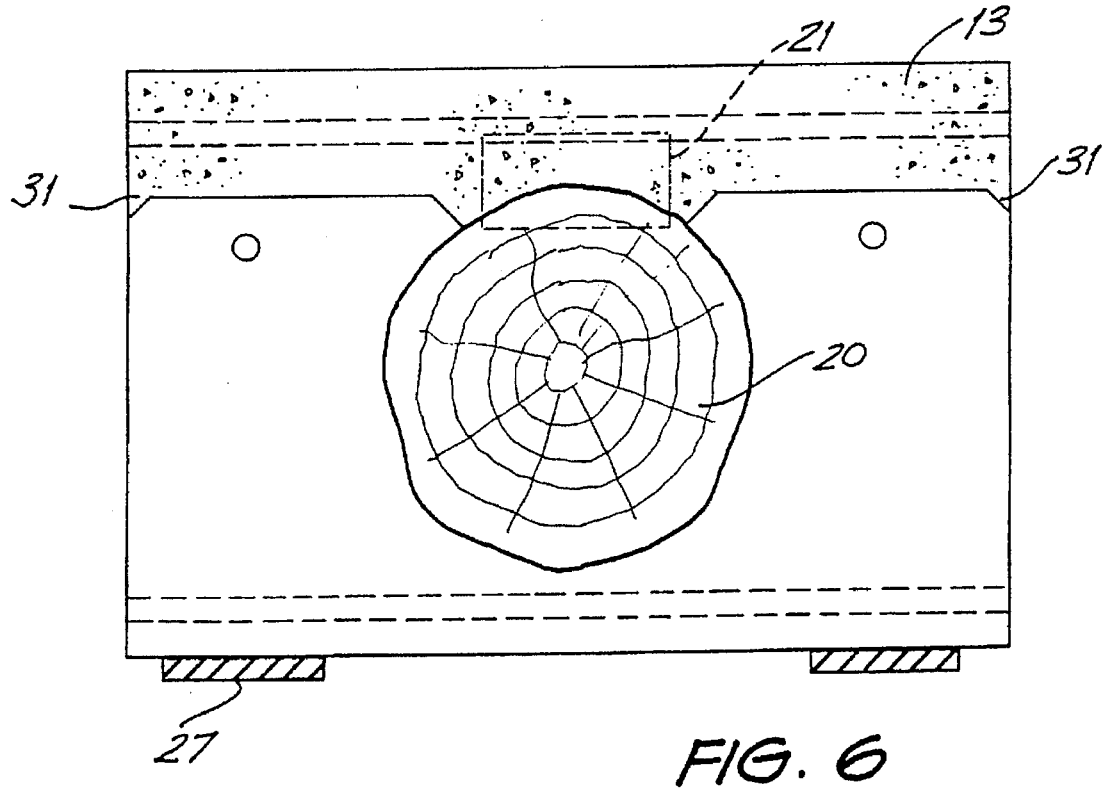
FIG. 6 is a cross-section through a module illustrating the use of a round timber and shear connector.

As shown in FIG. 6, it may be advantageous to provide drip catchers 31 along each lateral edge of the deck 13. The drip catchers help keep the girder dry by diverting dripping water away from whichever girder is used. FIG. 6 illustrates a simple shear connector 21 in the form of a rectangular steel plate. It will be understood that a wide variety of shear connectors may be used to facilitate the transfer of bending loads from the deck into the girder.

Figure 7:
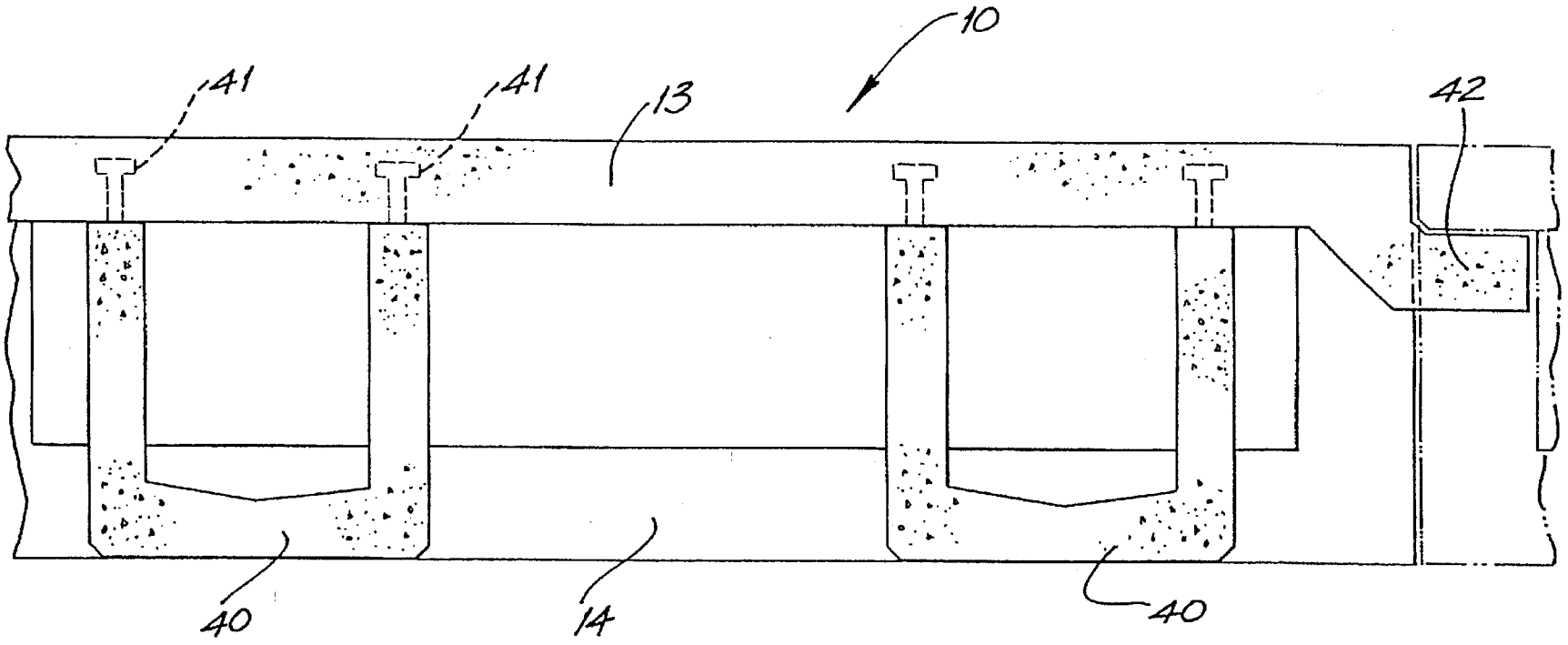
FIG. 7 is a cross-section through a double width module in which a hollow reinforced cast concrete beam is itself affixed to the deck surface.

FIG. 7 illustrates an alternate embodiment of the invention which diverges in some respects from the embodiments depicted in FIGS. 1–6. As shown in FIG. 7, two girders 40 are affixed, owing to the use of shear connectors 41, into the deck slab 13 of a module 10. In this instance, the module 10 is a double width module and utilises two girders 40. More than two girders may be used. Rather than being flat, the lateral edges of the module 42 are stepped to allow an overlapping with an adjacent module or structure. In the example shown in FIG. 7, a hollow concrete girder 40 is employed.

Figure 8:
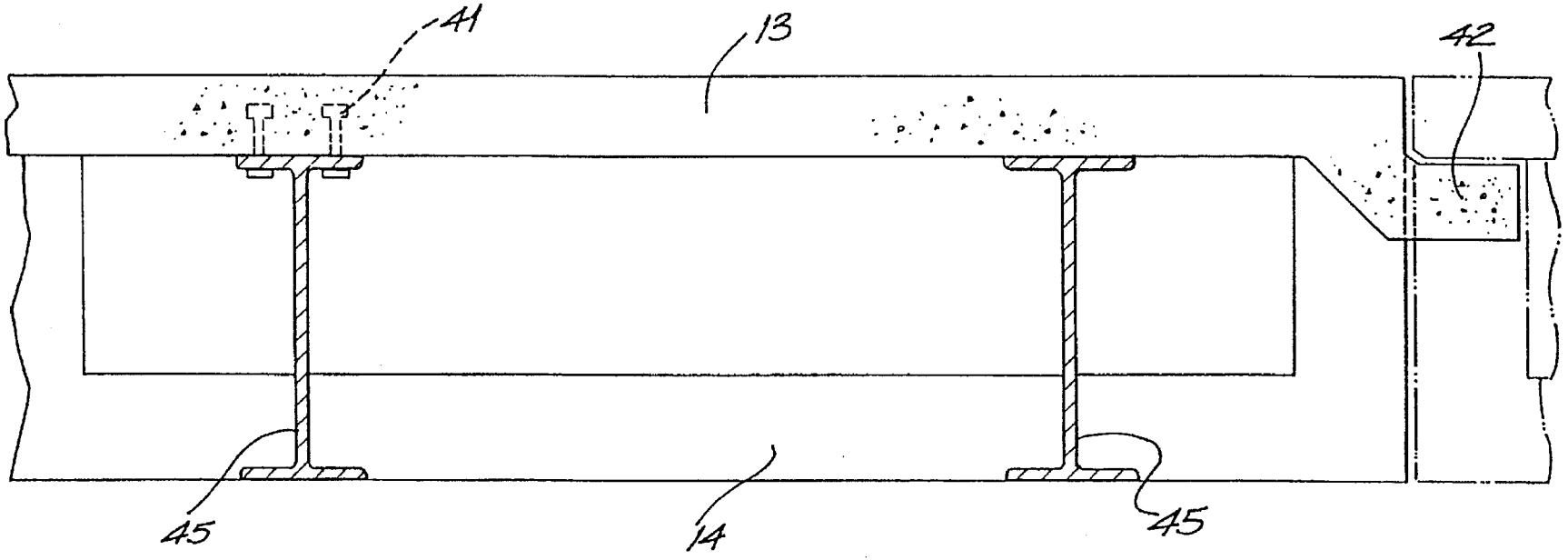
FIG. 8 is a cross-section through a double width or larger module in which steel I-beams are used in place of round timbers.

As shown in FIG. 8, the same principles depicted in FIG. 7 may be applied to a module in which a steel I-beam 45 is used in place of timber or concrete girders.

Figure 9:
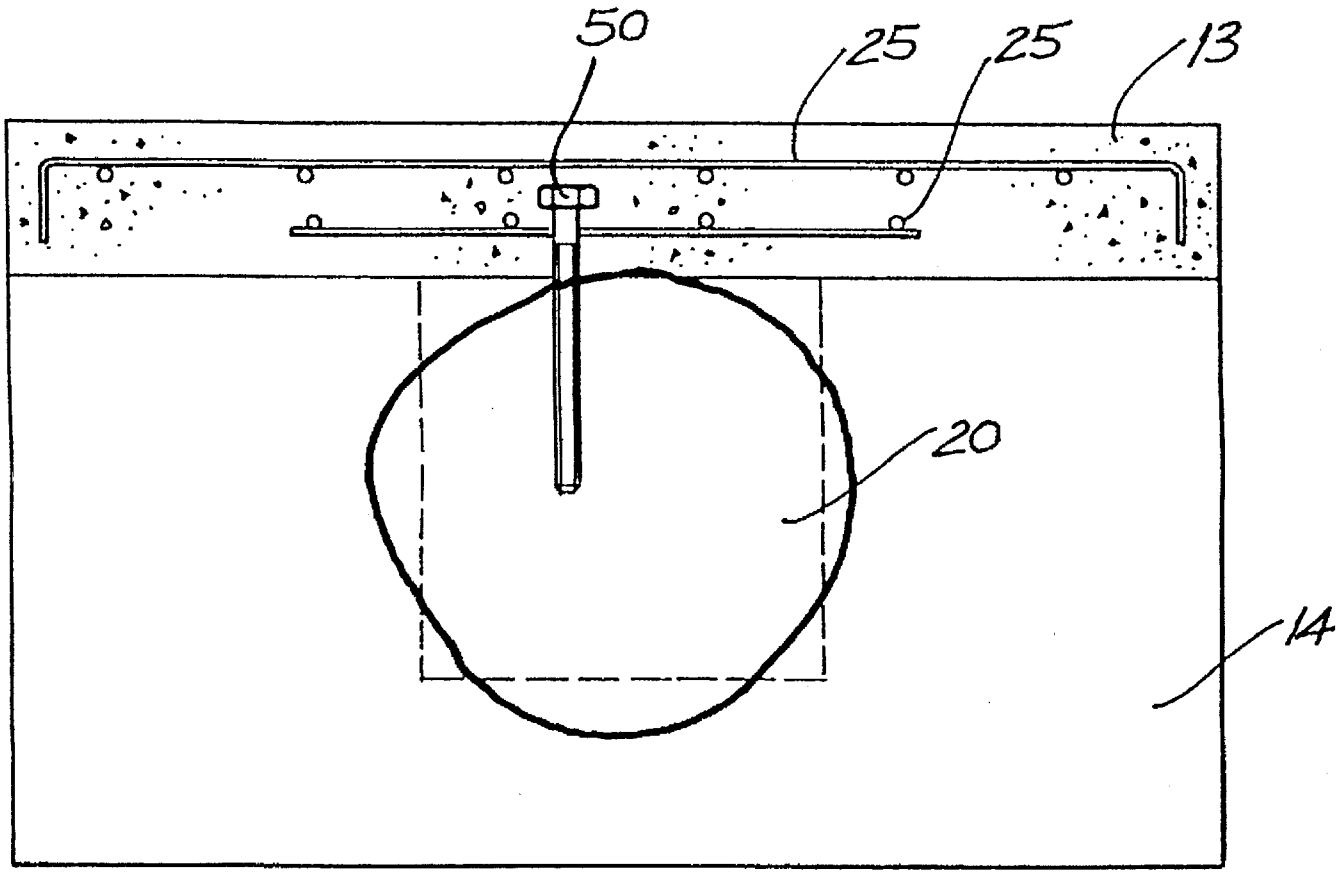
FIG. 9 is a schematic cross-section through a module illustrating the location of reinforcements and a method of using bolts or studs as shear connectors.

FIG. 9 illustrates a round timber 20 which may be partially embedded into a deck 13. In this example, a bolt 50 rather than a rectangular plate is used as a shear connector. Reinforcement 25 is provided in the deck and in the diaphragm (reinforcement not shown). In fact two or more bolts 50 may be used to facilitate the shear connection between the deck 13 and the girder.

Figure 10:
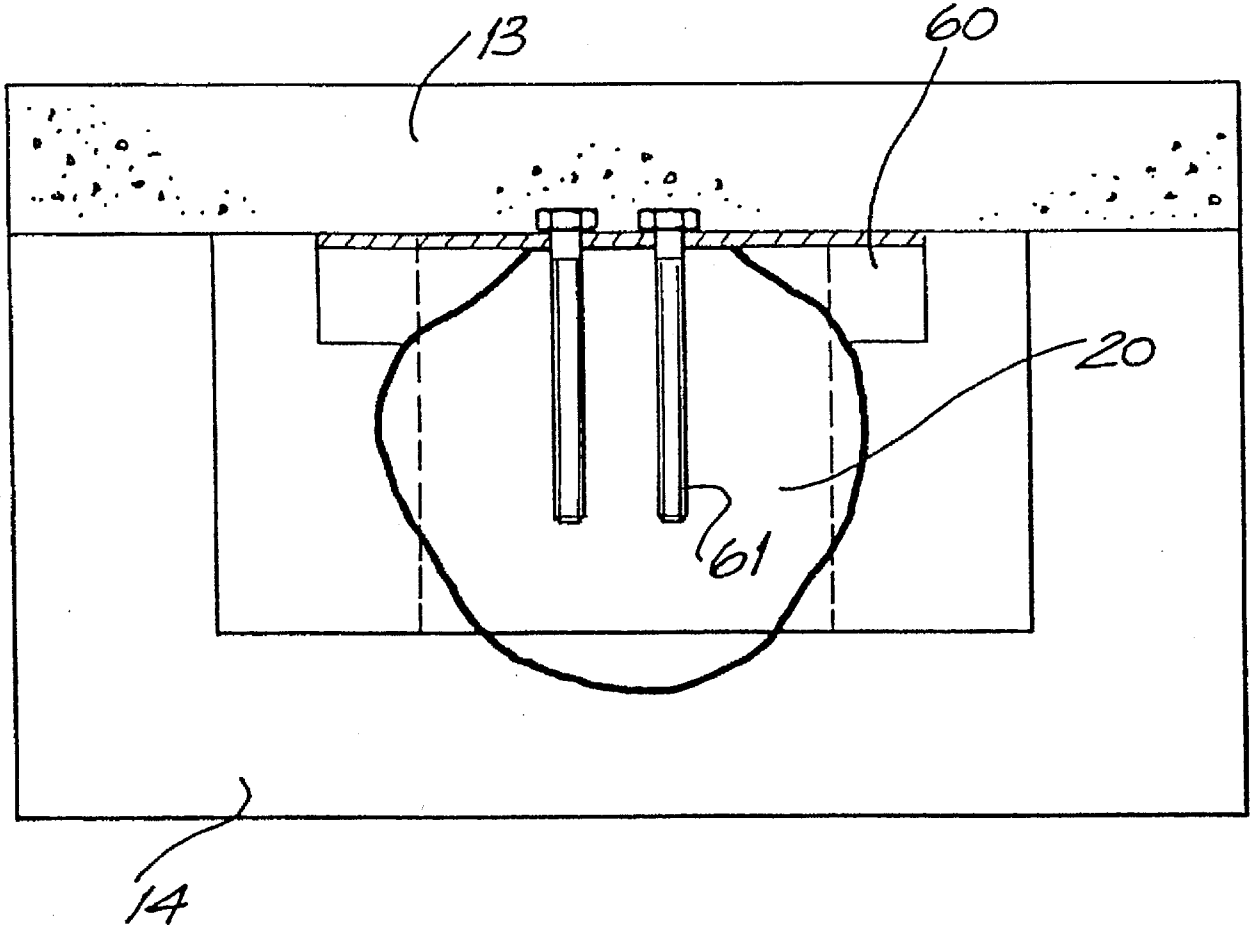
FIG. 10 is an alternate method of attachment of a round or square timber beam to the deck.

FIG. 10 illustrates another method of shear connection. Here a bracket 60 is interposed between the timber girder 20 and the deck 13. Bolts 61 pass through the bracket 60 and into the timber girder 20. The bracket 60 is embedded in the cast concrete deck 13 or may be attached to it by bolts or studs (not shown). The bracket may take any number of specific forms.

Figure 11:
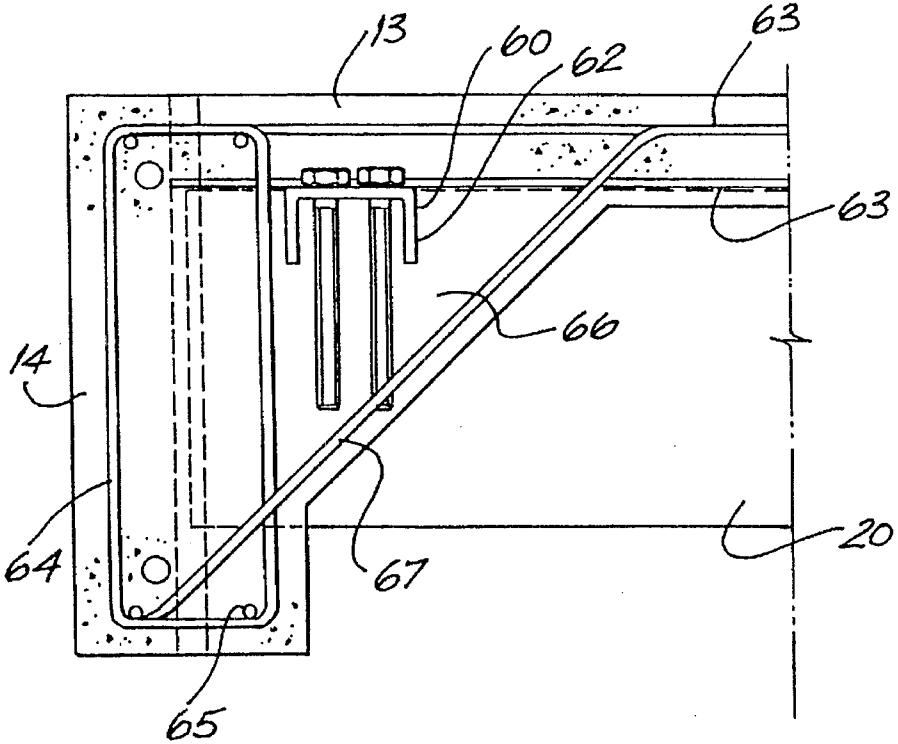
FIG. 11 is a longitudinal cross-section through a portion of a module illustrating the location of reinforcement members and illustrating the interconnection between beam and deck.

FIG. 11 illustrates how a bracket 60 may be employed in a generally "C" configuration. The bracket or channel has parallel sides 62 which extend into parallel slots formed in the timber girder 20. In this instance, two layers of reinforcement 63 are provided in the cast deck 13. Further, the diaphragm 14 is also reinforced with steel rods 64 which are wrapped around transverse reinforcements 65. Note that in this embodiment, a lateral fillet 66 is used to interconnect the diaphragm 14 and the deck 13 in the corners between the deck and diaphragm. A steel reinforcement 67 passes through the interior of the fillet 66 and extends from the diaphragm 14 into the deck 13.

Figure 12:
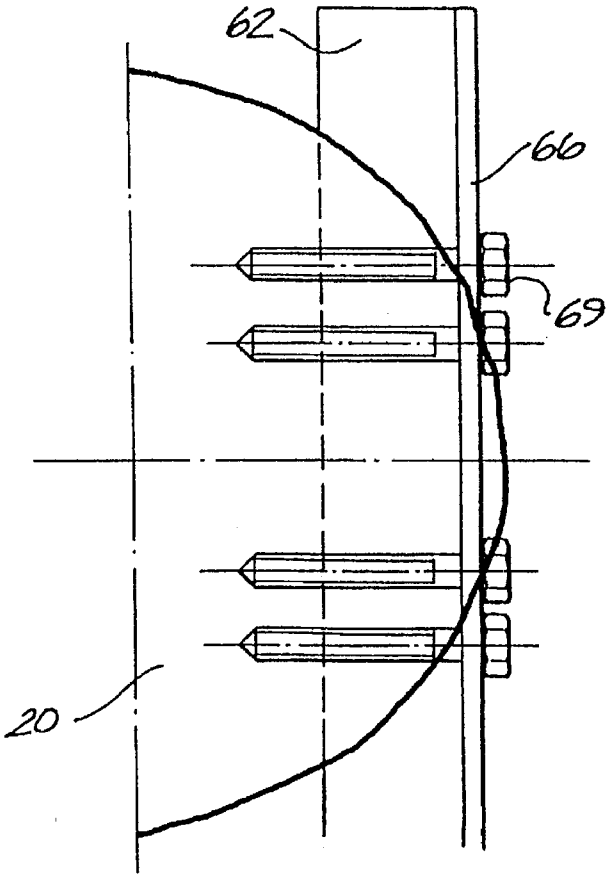
FIG. 12 is a detail illustrating a method of shear connecting a beam or girder to a deck.

FIG. 12 illustrates a bracket 60 in which two pairs of adjacent bolts 69 pass through the bracket 66 into the timber girder 20. A plurality of such bracket and bolt arrangements are used along the length of the timber girder 20.

Figure 13:
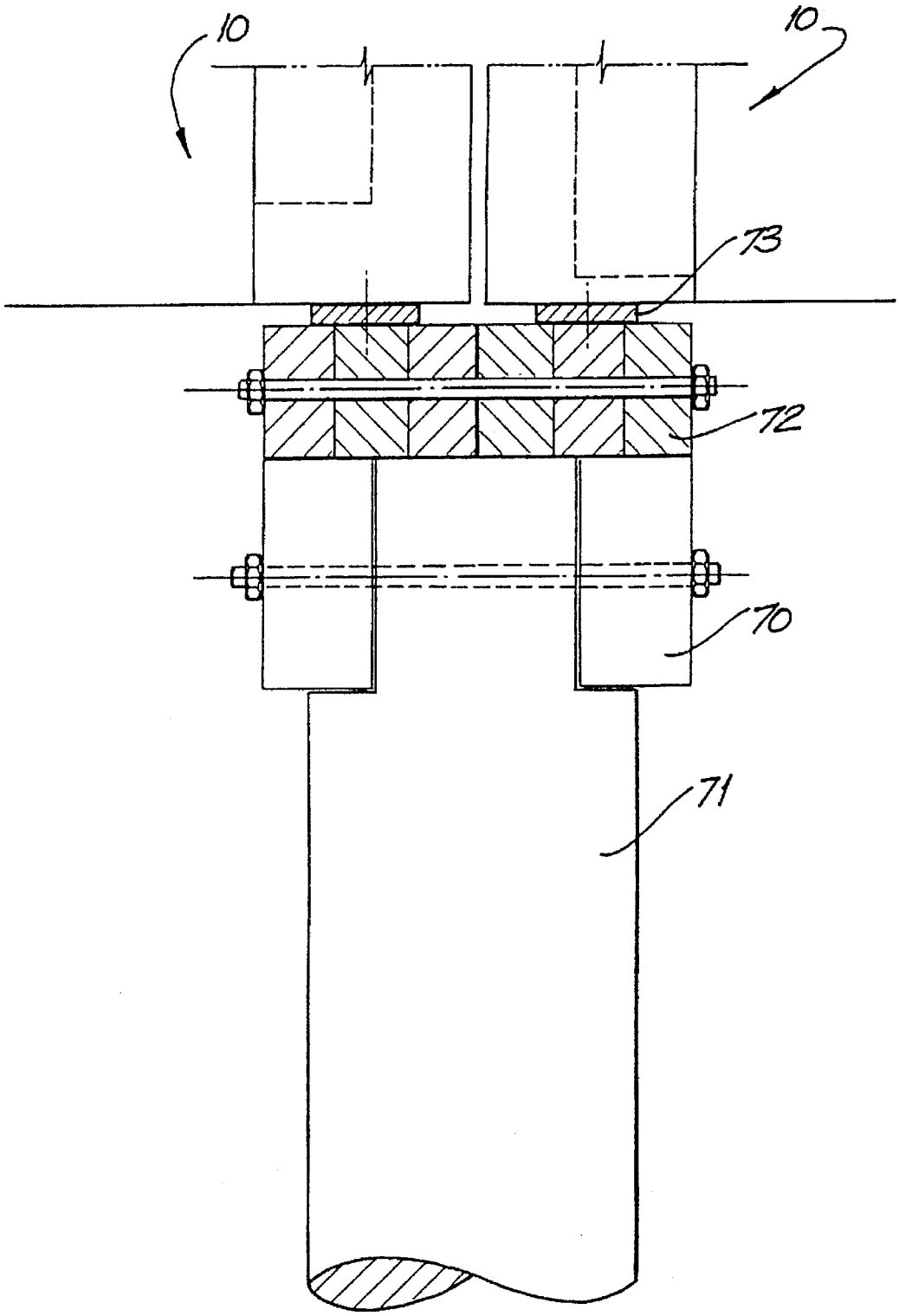
FIG. 13 is a detail of a pier or support onto which modules have been stacked.

FIG. 13 illustrates some details of a typical assembly at a timber bridge pier. The existing wales 70 associated with a pile 71 are used to support a new crosshead 72 which may be made from laminated treated pine. The new crosshead may be bolted together. The new crosshead then supports one or more of the modules of the present invention 10. These may be supported above elastomeric pads 73, if required.

Figure 14:
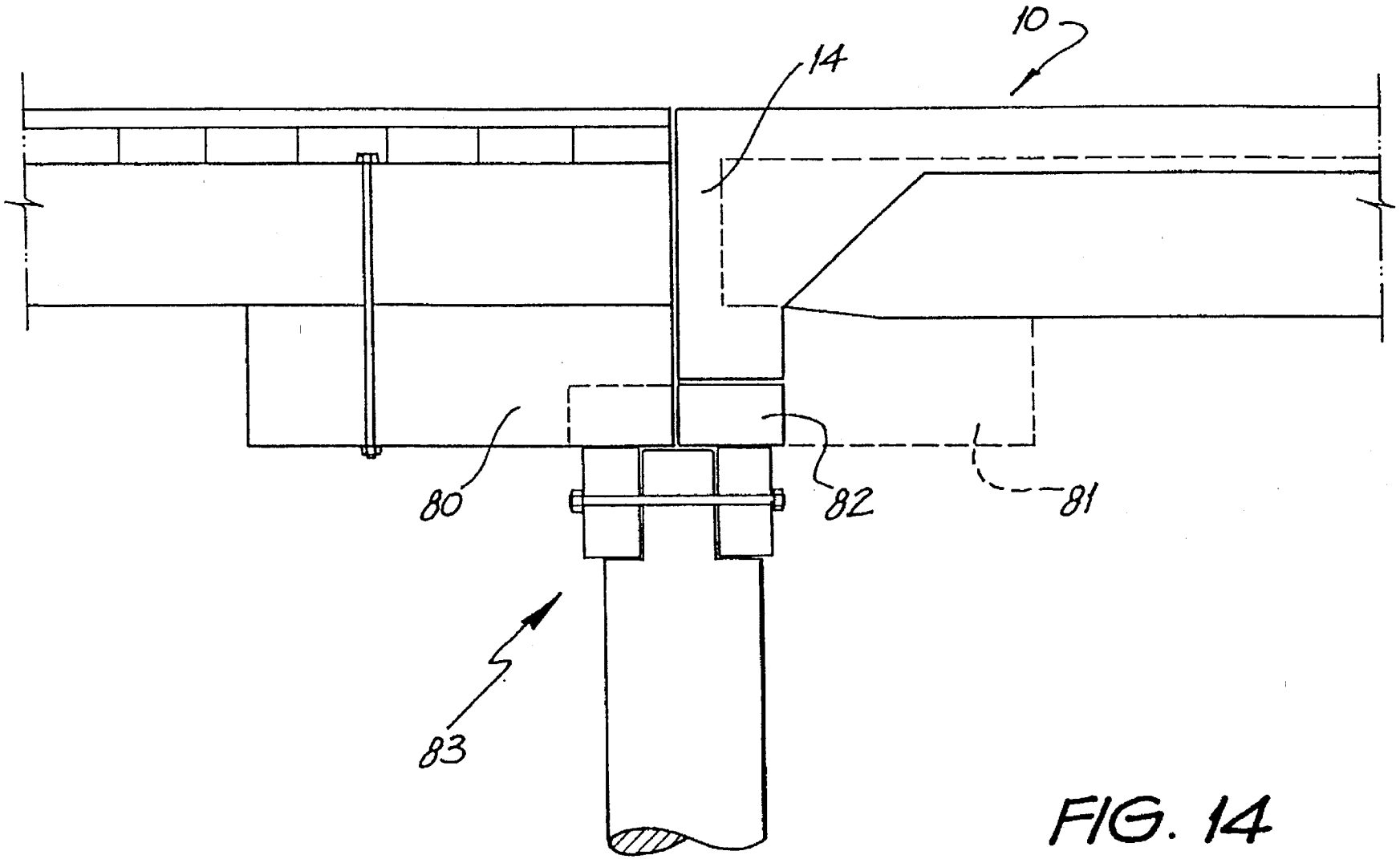
FIG. 14 is a side elevation of a portion of a bridge, the right hand of which has been repaired and the left hand of which is awaiting repair.

FIG. 14 illustrates how a bridge may be repaired, in sections. As shown in FIG. 14, the original corbel 80 is cut in half and one half of the original corbel 81 is removed. If required, a new spacer or crosshead 82 is provided above the existing wales. This prepares one half of the bridge pier 83 to accept a module 10 of the present invention. The module 10 is then laid on top of the crosshead or spacer 82 so that a diaphragm 14 rests on the spacer or crosshead 82. The other half of the bridge pier section may then be repaired in this same fashion. Bolts can be used to hold the adjacent diaphragms 14 together.

Figure 15:
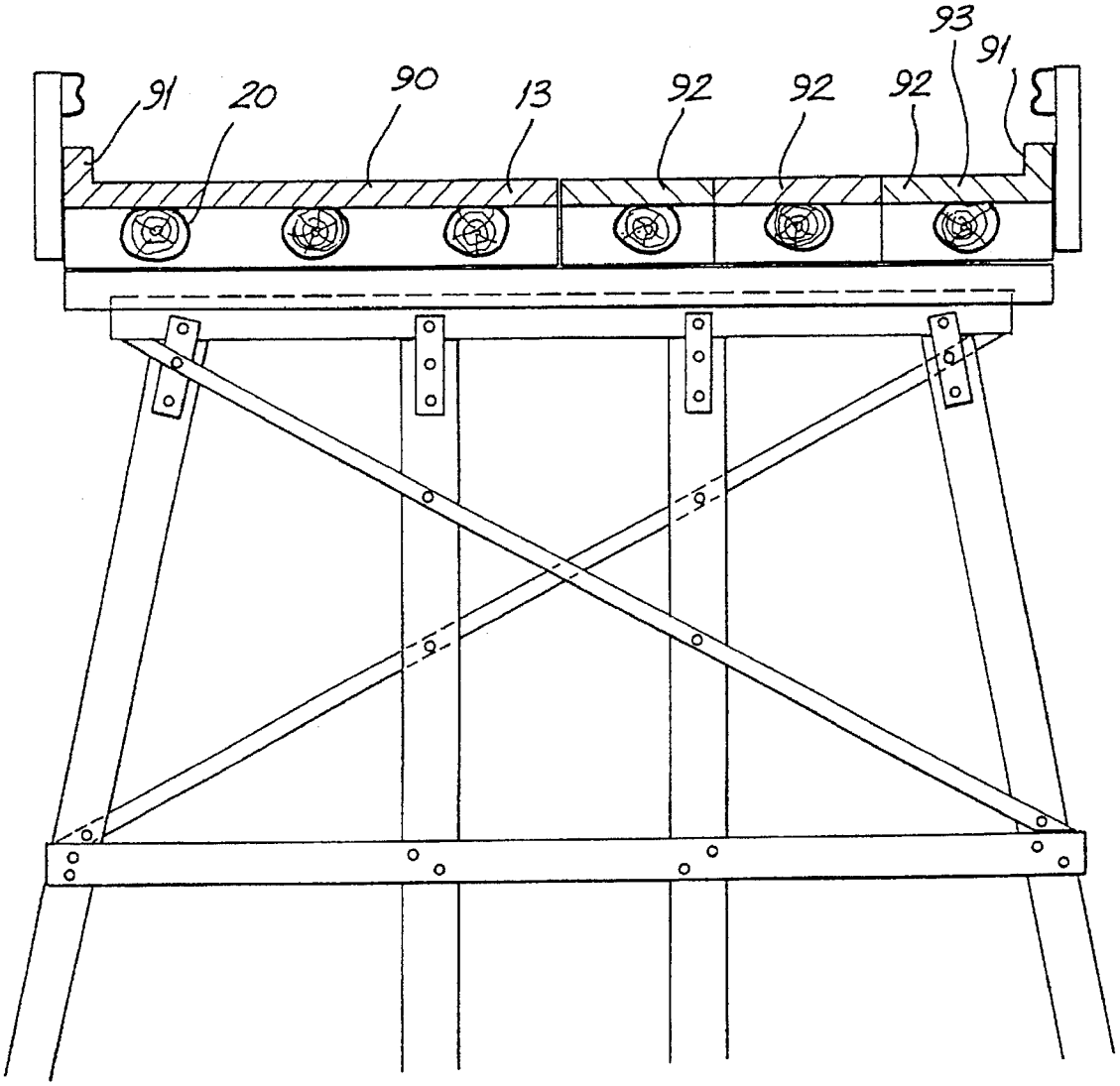
FIG. 15 is a front elevation, partially sectioned, of an existing timber bridge which has been repaired according to the teachings of the present invention.

FIG. 15 illustrates a multi-lane construction in which two different module types are used for the purpose of illustration. On the left of FIG. 15 a three unit module 90 is used. Each module 90 includes three round timbers 20. The deck 13 may be cast with an integral curb 91 which is preferably 200×200 mm square. On the right side of the road illustrated in FIG. 15, three separate modules 92 are utilised. Only one of the modules 93 incorporates an integral curb 91.

Figure 16:
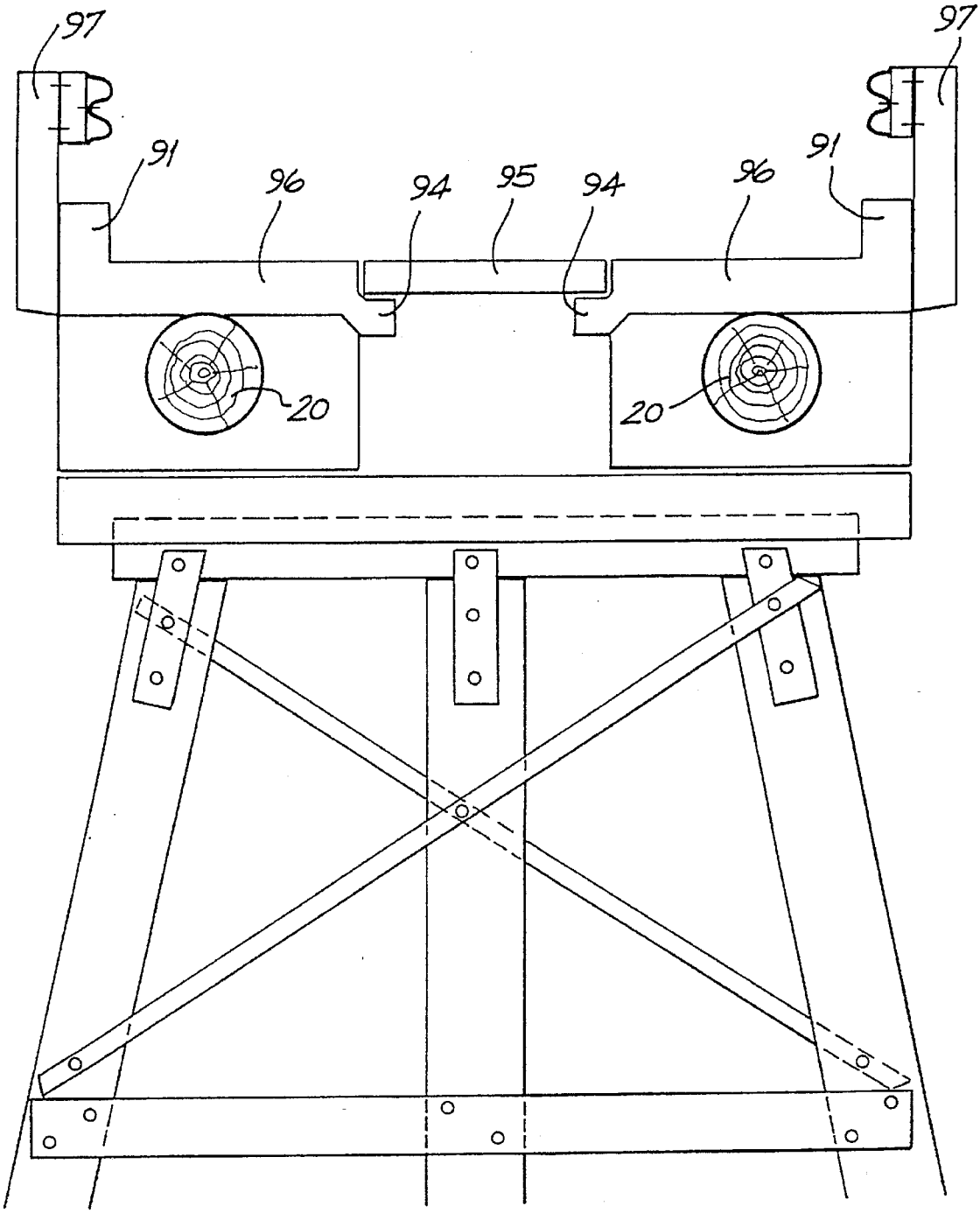
FIG. 16 illustrates how modules may be formed in alternate embodiments.

Another embodiment is depicted in FIG. 16. Here, the interior lateral edges 94 of each of the adjacent two modules are configured similarly to the stepped arrangement depicted in FIG. 7. An intermediate slab 95 extends between the two modules 96. Guard rails 97 are affixed directly or indirectly to the modules 96. In the example of FIG. 16, the width of the road bed is defined by the width of the two modules together with the width of the intermediate slab.

Figure 17:
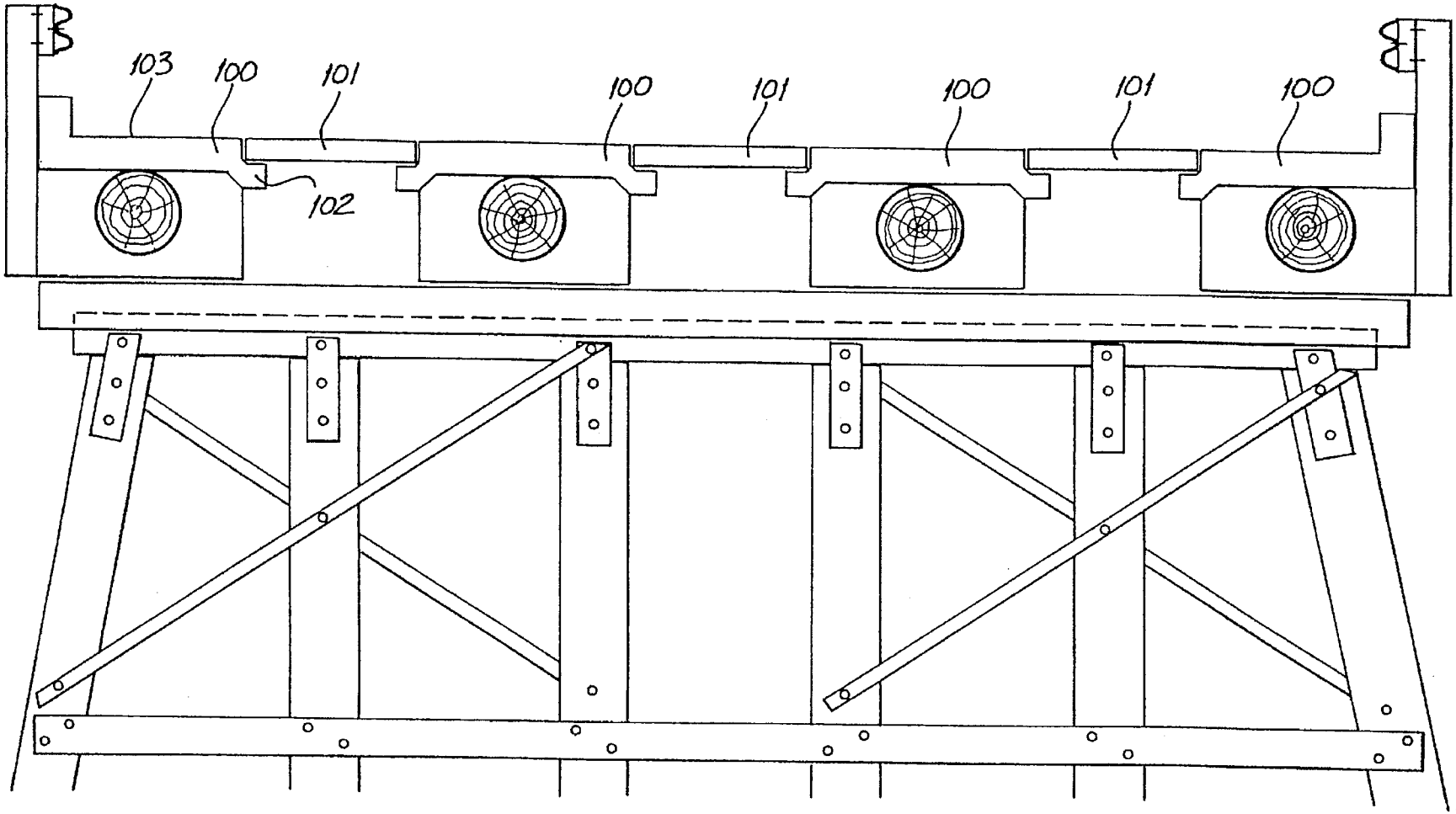
FIG. 17 illustrates a multi-lane roadway which has been repaired according to the teachings of the present invention.

FIG. 17 illustrates that a plurality of single width modules 100 may be used to transversely span a road bed. Intermediate slabs 101 interconnect adjacent modules 100. The stepped lateral edges 102 of each module allow the intermediate slab 101 to lie flush with the upper or road surfaces 103 of each module 100.

Figure 18:
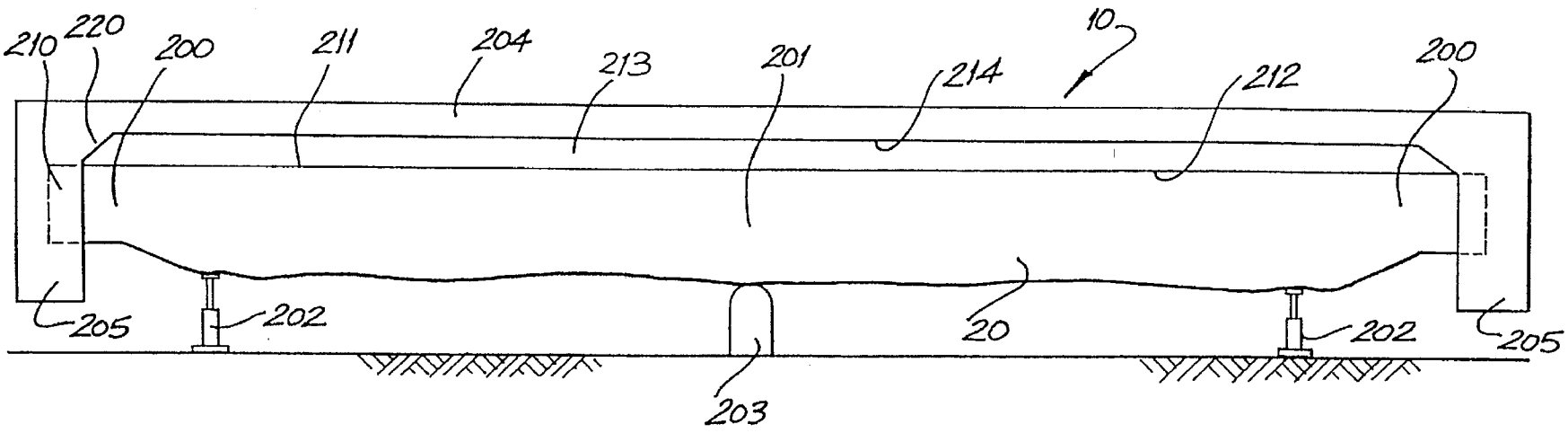
FIG. 18 is a schematic side elevation illustrating upright casting and pre-stressing of a module utilising a round timber with square trimmed ends.

An alternate method for module construction is suggested by FIG. 18. Utilising this method, the module is cast upright rather than inverted (as shown in FIGS. 3 and 4). This method allows the round timber 20 to be pre-stressed. This is accomplished by supporting the timber 20, at or near the middle so that the ends of the timber 200 sag below the level of the middle portion 201. This allows the ends to be adjustably raised or lowered so as to achieve a degree of curvature in the timber 20. Any suitable apparatus 202 may be used to support the ends 200. For example, hydraulic or mechanical jacking devices are suitable for this purpose. Depending on such parameters as the length and diameter of the timber 20, the dimensions of the module 10 and the degree of pre-stressing desired, the adjustable supports 202 are used to introduce a predetermined extent of bending in the timber 20. In essence, this represents a generally symmetrical sagging of the timber 20, which sagging is maintained by the central support 203 and the outer adjustable supports 202. The cast reinforced concrete portion 204 is then formed around the pre-stressed timber 20. By pre-stressing the timber 20, the module sags less when supported by its diaphragms 205 and deflects less in the vertical direction when loaded from above. It will be appreciated that depending on the extent of the sag of the ends 200, the finished module 10 may be intentionally formed with a degree of "hog" or over vertical curvature.

Figure 19:
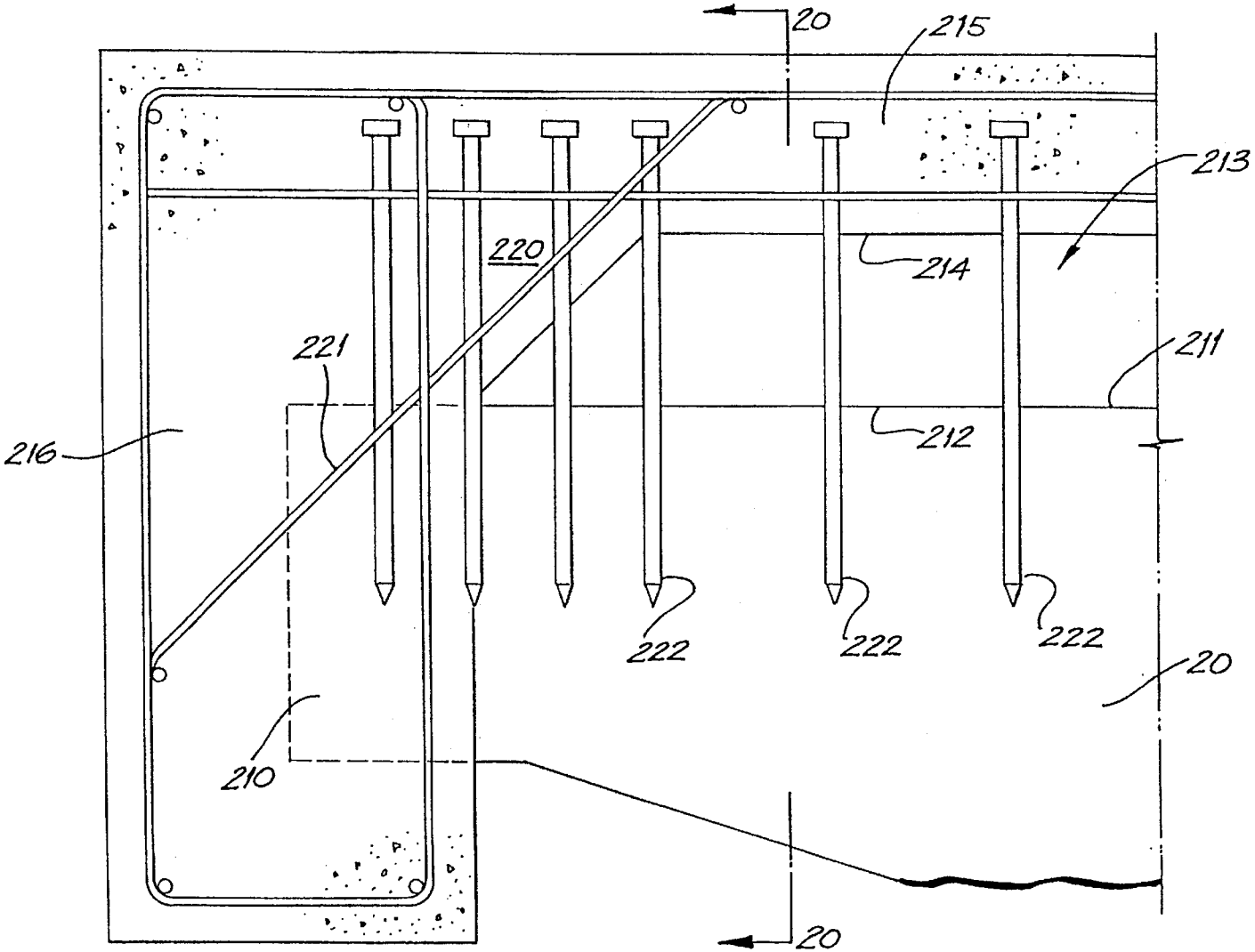
FIG. 19 is a cross-sectional view of an end of the module depicted in FIG. 18.

FIG. 19 illustrates a cross-section through an end of a module, for example of the type illustrated in FIG. 18. In this example, a round timber 20 is trimmed so that its end 210 is square or rectangular in cross-section. In addition, a top surface 211 is also trimmed to be flat and flush with a lower surface 212 of a rib 213 which extends down from the lower surface 214 of the deck 215. The square or rectangular trimmed end 210 preferably extends about 150 mm into the diaphragm 216 and is in this example about 300 mm square in cross-section. The protruding rib 213 spaces the timber 20 away from the deck 215 and also allows line contact to occur between the flat trimmed upper surface 211 of the timber 20 and the slab which comprises the deck 215 and rib 213. Fillets 220 are provided between the deck 215 and diaphragm 216. They both strengthen the intersection between deck and diaphragm and also allow reinforcement members 221 to pass, on the diagonal, from the diaphragm 216 into the deck structure 215. In this example, shear coupling is accomplished with nails, bolts, rods or studs 222 which are embedded into the timber 20 and extend into and are cast into the rib 213 and deck 215. Preferably, the shear coupling elements 222 extend into the steel reinforcement mesh which forms part of the deck structure. The shear coupling elements 222 do not need to be oriented vertically with respect to be deck surface. They may be inclined to better accommodate the stresses and timber shrinkage of a particular application.

Figure 20:
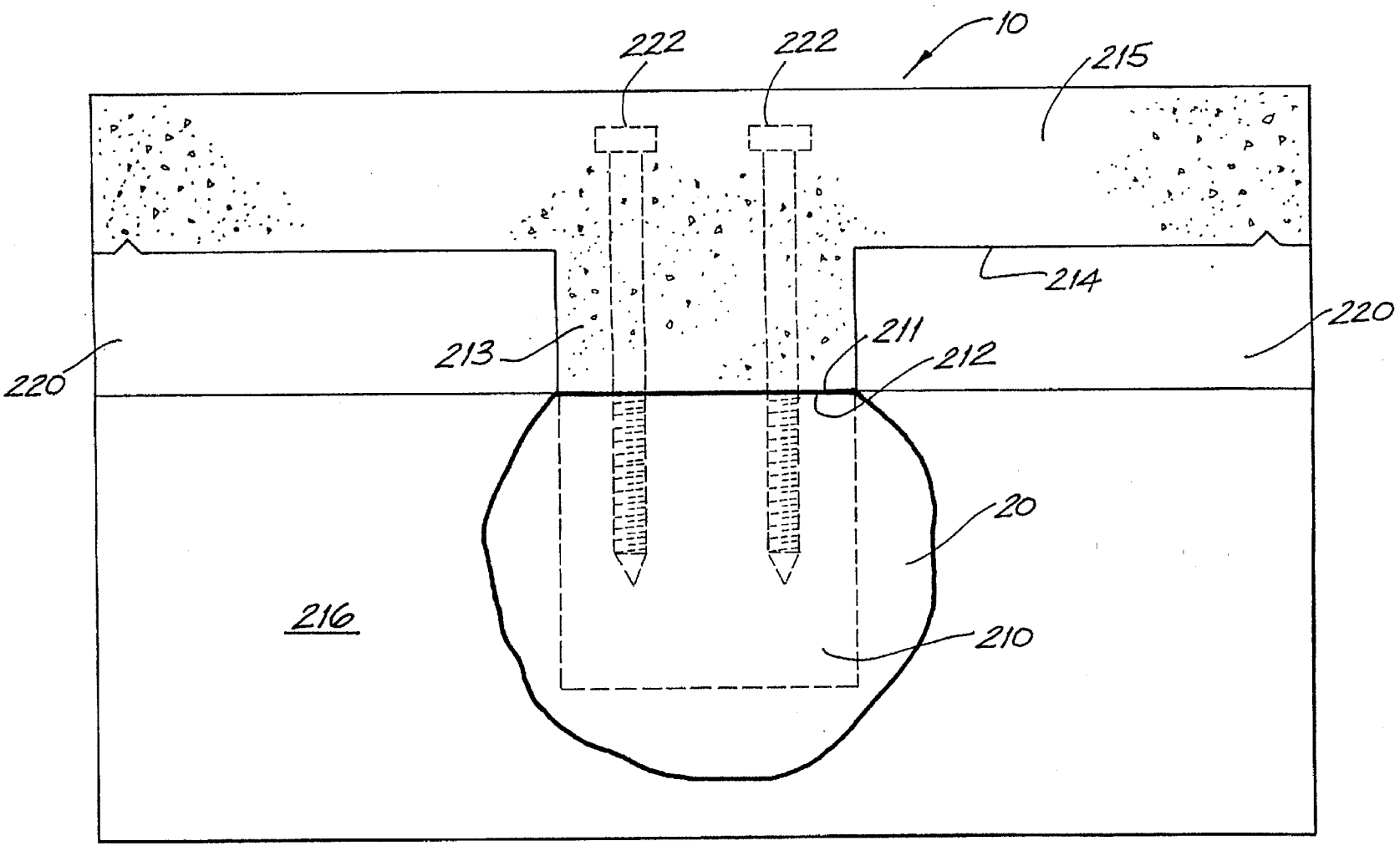
FIG. 20 is a cross-section through lines 20—20 of FIG. 19.

FIG. 20 illustrates the orientation of the timber 20 relative to the rib 213 which extends the full length of the module 10 between the diaphragms 216. This figure also illustrates the fillets 220 which may be located in the corners between the deck 215 and diaphragms 216.

Figure 21:
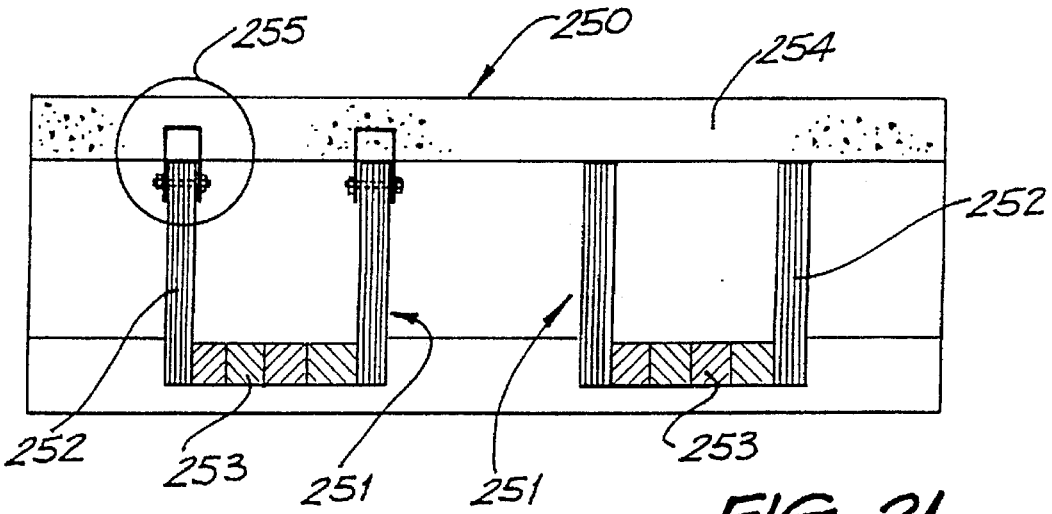
FIG. 21 is a cross-section of a module utilising a box beam. The box beam is fabricated from laminated timber sides and is anchored into the cast deck.

FIG. 21 illustrates a module 250 which utilises two girders 251. Each girder 251 is built in the form of a box beam. The box beam further comprises sides 252 fabricated from laminated timber veneer or other engineering timbers. The bottom 253 in this example is fabricated from adjacent lengths of solid timber, square in cross-section. The built-up sides 252 of each box beam 251 are anchored into the reinforced deck 254 by a series of connectors 255, illustrated in more detail in FIG. 23.

Figure 22:
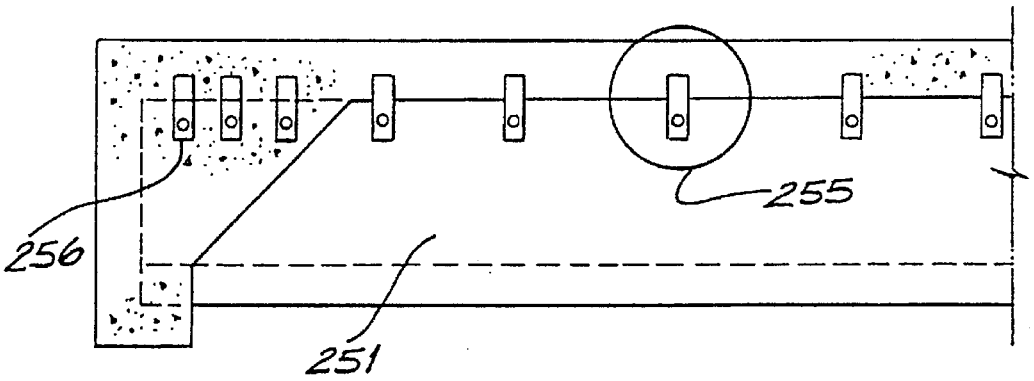
FIG. 22 is a side elevation of the module depicted in FIG. 21.

FIG. 22 illustrates how a series of yoke-like connectors 255 extend down the length of the girder 251, some of the connectors or anchors 256 being completely embedded in the cast concrete structure.

Figure 23:
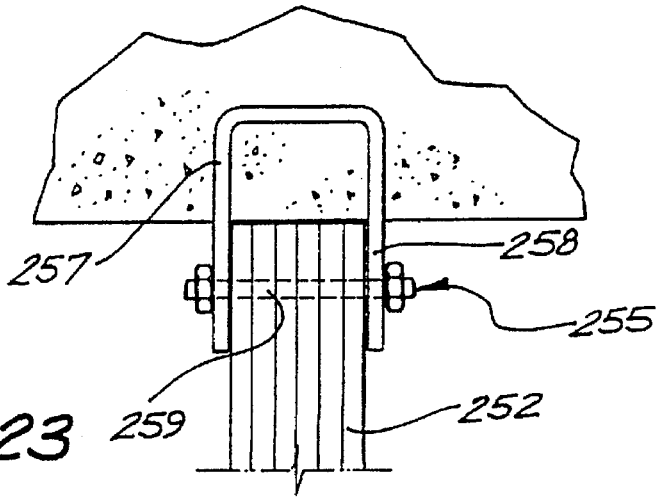
FIG. 23 is a cross-section of the detail encircled in FIG. 21.

As shown in FIG. 23, each of the connectors 255 may comprise a yoke 257 which is partially embedded. The legs 258 of the yoke are interconnected by a fastener 259 which passes through the side 252 of the girder 251.

FIG. 24 illustrates an example of a building construction utilising the modules of the present invention. As illustrated, a floor 260, a wall 270 and a roof 280 may all be fabricated utilising cast concrete deck-like surfaces with integral diaphragms, a beam extending between the opposed diaphragms of each module.

FIG. 25 illustrates an alternate embodiment for anchoring or shear coupling the sides of a girder to the reinforced deck. In this example, an anchor or shear coupler 290 comprises opposed plate-like elements 291 each having nails or teeth 292 aligned along an interior surface. The opposed jaws or sides 291 of the anchor 290 are set into the girder or girder portion using bolts 300 which pass through the sides 290. The upper portion of the anchor or shear coupler is itself embedded in the reinforced and cast concrete deck.

FIG. 26 illustrates how two modules 310 may be maintained in position by a specially adapted support 320 which is affixed to a pier 321. As shown by FIG. 26, each module comprises one or more longitudinal bores 322 which are used to interconnect modules which are end-to-end with respect to one another. A fastener is inserted through the aligned bores 322 and prevents adjacent diaphragms from separating. Transverse bores 323 are also provided for the purpose of aligning and fastening laterally adjacent modules. One or more vertical bores 324 may also be provided. The vertical bore 324 allows a fastener 326 to be passed through it for the purpose of anchoring the module with respect to a convenient support. One such support 320 is illustrated in FIG. 26. The support comprises a reinforced and cast concrete deck 325 into which is set a round timber section 327. The timber section 327 is secured by any number of shear couplers 328 which are at least partially embedded in the reinforced concrete deck 325. The round timber 327 is then supported by and anchored to a pier 321 in any one of a number of convenient ways.

As shown in FIG. 27, the vertical fastener 326 carries a ferrule 330 at a lower end. The ferrule is embedded into the reinforced concrete deck 325 of the support 320.

While the invention has been disclosed with reference to particular materials and details of construction, these should be understood as having been provided, particularly where indicated, as examples and not as limitations to the scope or spirit of the invention.

I claim:

1. A structural module comprising:

a cast concrete portion; and a girder;

the cast concrete portion comprising a reinforced deck having a reinforced load bearing diaphragm at opposite ends extending below the girder for placement on a support;

the girder extending between the diaphragms and protruding into each diaphragm while being shear and tension coupled to the deck such that forces induced in the girder are transferred to the diaphragm via the coupling between the girder and the deck.

2. The module of claim 1, wherein the diaphragms are integral with the deck and have flat bottom faces.

3. The module of claim 1, wherein the girder is shear coupled to the deck by a plurality of shear and tension connectors, spaced along the girder and extending into both the girder and an underside of the deck.

4. The module of claim 3, wherein the connectors are steel plates.

5. The module of claim 3, wherein the connectors comprise one or more bolts or studs.

6. The module of claim 1 wherein the girder is comprised of timber.

7. The module of claim 1, further comprising at least one additional girder extending between the diaphragms and being shear and tension coupled to the deck.

8. The module of claim 1, wherein a lateral edge of a module comprises a stepped portion adapted to receive an intermediate slab and support the intermediate slab generally flush with a top surface of the module.

9. The module of claim 1, wherein the deck is provided with one or more transverse passages which are adapted to allow a fastener to pass completely therethrough.

10. The module of claim 1, wherein the girder is prestressed in a vertical plane.

11. The module of claim 10, wherein the module incorporates an over vertical curvature such that when the module is supported by the diaphragms, a centre portion of the module is higher than either end.

12. The module of claim 11, wherein the girder is a timber girder having its top surface trimmed flat.

13. The module of claim 12, wherein the ends of the timber girder are trimmed square.

14. The module of claim 1, wherein the deck further comprises a lower surface from which extends a rib, the rib extending between the diaphragms and having a flat lower surface adapted to make line contact with the girder.

15. The module of claim 1 comprising a load transmitting fillet between each diaphragm and the deck.

16. A method of making a structural module comprising the steps of:

casting a concrete portion to define a reinforced deck having a reinforced load bearing diaphragm at opposite ends;

placing a girder to extend between the diaphragms;

shear and tension coupling the girder to the deck to transfer forces induced in the girder to the diaphragms via the coupling between the girder and the deck;

wherein the concrete portion is cast such that the surface of the deck is the lower most surface of the casting and the diaphragms extend above the girder.

* * * * *